United States Patent [19]

Baumgarten

[11] 4,078,323

[45] Mar. 13, 1978

[54] METHOD AND APPARATUS FOR THE CONTINUOUS TREATMENT OF A WEB OF PAPER, TEXTILE, SYNTHETIC MATERIAL METAL OR THE LIKE THROUGH THE APPLICATION OF PRESSURE PRODUCED BY MAGNETIC FORCE

[75] Inventor: Heinrich Ludwig Baumgarten, Darmstadt, Germany

[73] Assignee: Fa. Kleinewefers Industrie-Companie GmbH, Germany

[21] Appl. No.: 705,521

[22] Filed: Jul. 15, 1976

[30] Foreign Application Priority Data

| | | |
|---|---|---|
| Jul. 15, 1975 | Germany | 2531505 |
| Mar. 18, 1976 | Germany | 2611428 |
| Mar. 19, 1976 | Germany | 2611586 |

[51] Int. Cl.[2] ..... D21G 1/02; D06F 63/02

[52] U.S. Cl. ..... 38/44; 38/57

[58] Field of Search ..... 19/107, 65 CR; 242/147 M; 38/1 R, 1 C, 17, 18, 44–61, 19–34

[56] References Cited

U.S. PATENT DOCUMENTS

| | | | |
|---|---|---|---|
| 949,351 | 2/1910 | Clayton | 38/17 |
| 3,357,062 | 12/1967 | O'Neal et al. | 19/98 X |
| 3,922,765 | 12/1975 | Hogendyk | 38/44 X |

OTHER PUBLICATIONS

Gunter & Cooke "ad".

*Primary Examiner*—Werner H. Schroeder
*Attorney, Agent, or Firm*—Hill, Gross, Simpson, Van Santen, Steadman, Chiara & Simpson

[57] ABSTRACT

Webs of paper, textile, synthetic material, metal or the like are subjected to a continuous treatment through the application of pressure produced by magnetic forces exerted via pressure bodies perpendicularly to the web. The web is guided over a straight or arcuate supporting surface and the pressure bodies extend over the width of the web. The pressure bodies are constituted by a plurality of freely movable balls, rings, rollers or pins having less diameter, or length, respectively, than the width of the band and are held adjacent one another essentially in the transverse direction of the band. The plurality of balls, rings, rollers or pins are held in a stacked offset relationship transversely and/or in the direction of web travel in such a manner that the web is subjected to pressure by the pressure bodies over its entire width. The pressure bodies may be held in position by means of cages, strips, struts, rods or the like, or may be positioned and maintained by the magnetic field. In a plurality of embodiments of the invention, the mounting of the pressure bodies is achieved through the utilization of a pole shoe which, advantageously, may be adjustable toward and away from and/or transversely of the web.

38 Claims, 34 Drawing Figures

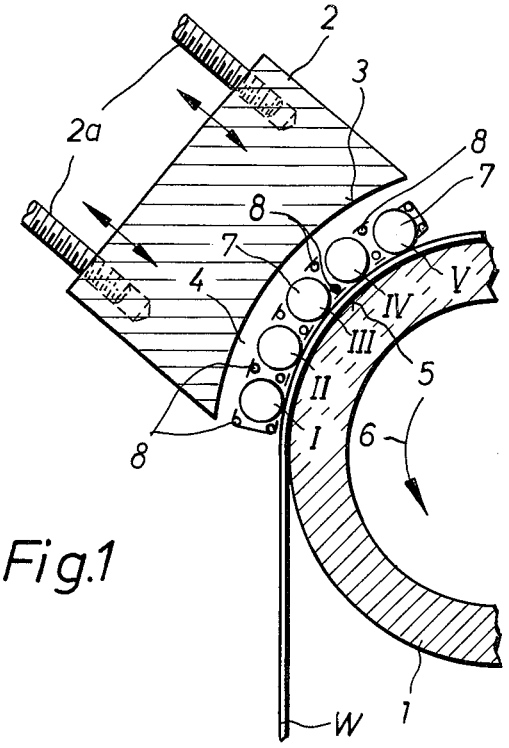
Fig.1
Fig.2
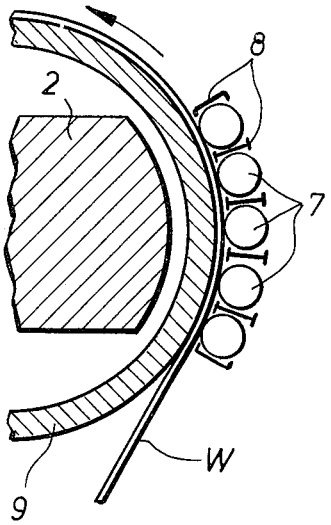
Fig.7
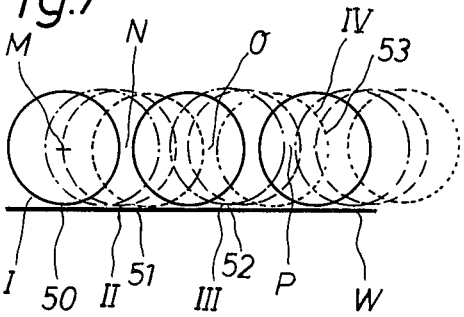
Fig.8
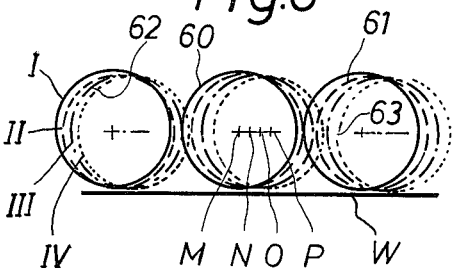
Fig.3
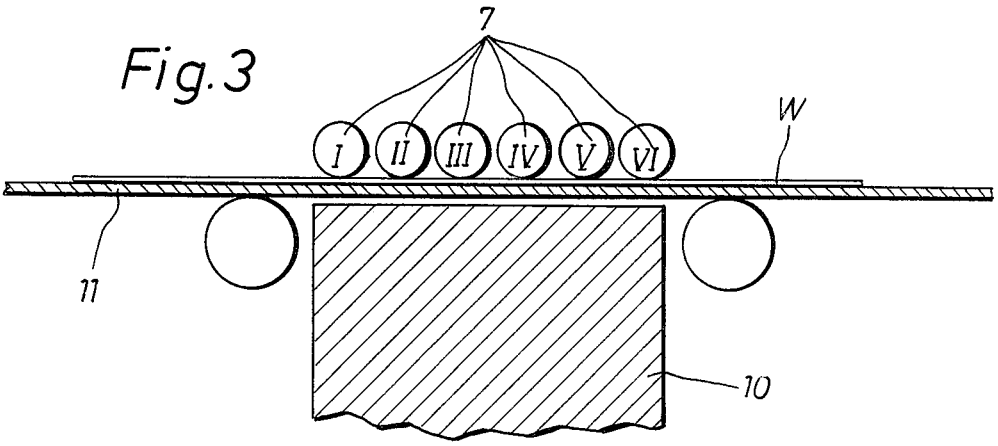

METHOD AND APPARATUS FOR THE CONTINUOUS TREATMENT OF A WEB OF PAPER, TEXTILE, SYNTHETIC MATERIAL METAL OR THE LIKE THROUGH THE APPLICATION OF PRESSURE PRODUCED BY MAGNETIC FORCE

BACKGROUND OF THE INVENTION

1. Field of the Invention

The present invention relates to a method and an apparatus for the continuous treatment of a thin band of wares made of paper, textile, synthetic material or metal through pressure produced by a magnetic force exerted by means of pressure bodies perpendicularly to the band, or path of travel of the band, whereby the band of wares is guided over a straight or arcuate supporting surface and the pressure bodies extend over the width of the band of wares.

2. Description of the Prior Art

The German Pat. No. 1,164,122 discloses an apparatus for producing a pressing effect on band-shaped materials, for example, textiles, whereby the material to be treated moves between the operating parts exerting a pressure against one another, which pressure is developed by means of a magnetic field penetrating the material, of which operating parts, at least one is constructed as a rotary roller on which the material is rolled. In this connection, at least one of the operating parts for exerting pressure is magnetic, or contains a magnet, whereby the roller is to exert a uniformly acting pressure on a material along a sleeve line.

The German published application No. 1,813,197 furthermore discloses an apparatus operating with magnetic pressure for applying pressure in the treatment of band-shaped materials in which both of the ferrite magnetic structural parts are disposed in the form of rollers, so that they move mutually in such a direction that the width of the gap therebetween is alterable. In order to be able to vary the magnetic force with which the pressure bodies become effective on the band of wares, over the width of the band, adjacently disposed individual magnets may be used, each of which magnets produces a magnetic field that is different from that of adjacent magnets.

A disadvantage connected with these known apparatus is that upon utilization of rollers as pressure bodies for bands uneven in the transverse direction of the band, uniform pressure treatment is not possible in the transverse direction. There takes place a lifting of the roller shaped pressure body from sections of the band of wares, when unevenness, for example, a reinforcement of the band of wares, such as a knubbing, a bump or swelling, or the like passes through the gap between the roller-shaped pressure body and the support, be the support a roller or a planar support, etc. The reinforcements of adjacent sections of the band of wares remain untreated. In addition, sagging or deflection of the rollers must be taken into account.

It should be understood that hereinbelow the band of wares is simply termed a "web", whether the same is paper, textile, synthetic material, metal or any other band of material and that any irregularity in the surface to be treated, such as knubbing, bumps, swelling, seams and the like are collectively termed as an "unevenness."

SUMMARY OF THE INVENTION

It is the object of the invention to provide a method and apparatus of the type generally described above which permits a simple construction of the apparatus and also with an uneven surface of the web, still makes possible over the entire width of the web a pressure treatment which is uniform to a great extent.

Also, a uniform pressure treatment is to be attained over the width of the band independently of the sagging or deflection of a pressure roller, as also of the counterbearing, for example, the supporting roller of a calender. Advantageously, aids for equalizing sagging or deflection of the support are eliminated. A pressure treatment may hereby be both a surface treatment as well as any other type of treatment, such as, for example, a squeezing of the web.

In order to attain the foregoing objectives, an apparatus of the type generally mentioned above is provided in which a plurality of pressure bodies are utilized. These bodies in the form of a plurality of balls, rings, rollers, pins or the like, having less diameter or length than the width of the web and are held in the transverse direction to the band substantially adjacent each other and independently movable with respect to one another perpendicularly to the surface of the band. The plurality of balls, rings, rollers, pins or the like are held stacked transversely offset consecutively over the web width in the traveling direction of the web in such a manner that the web is acted on over its entire width by the pressure bodies of the pressure body field thus formed.

The German published application No. 1,091,913 discloses a roller arrangement for nap-crushing or squeezing in which several cylindrical short rollers extend, with intermediary spaces, over the width of the web. The ends of each of these short rollers, arranged in pairs and superimposed, are held in a bearing; the rollers are driven by means of drive shafts arranged between the supports of adjacent rollers, in common, and with the same speed. Furthermore, the rollers of two series of rollers arranged following one another are offset mutually on hatches; the pressure of the upper against the lower rollers between which the web is guided takes place by means of hydraulic or pneumatic application of pressure to the support of the upper rollers. In the case of this known machine, the rollers and the intermediary spaces must be relatively long, as the intermediary spaces must receive the roller supports and the drive shafts. The length of the rollers accordingly does not permit the direct surrounding of an unevenness of a web, as also the individual rollers can assume no different circumferential speed for their adjacent rollers, in order to process the web with the same effect as the adjacent rollers at different spacings from the counterroller or the planar support. Beyond this, the expense of construction of the individual roller bearings, as well as the drive shafts and their drive, and the pressure apparatus of the upper rollers, is appreciable.

As mentioned above, unevenness of the web is to be understood as all differences in thickness of the web. In addition to this, however, the apparatus of the present invention is utilizable even with uniform surface quality, if the web is to be treated by means of pressure, for example, a web of paper is to be smoothed.

The balls, rings, rollers, pins or the like which form the pressure members may be held in position by means of cages, strips, struts, rods or the like. Thus, for example, upon the utilization of rings, the rings may be arranged in series, preferably on a rod having less diameter than the interior diameter of the rings, whereby a corresponding free radial mobility is afforded in respect of one another. As the magnetic field holds the pressure bodies in position, it is sufficient upon corresponding construction of the same, to hold only the outer pressure bodies of the field in position by means of cages, rods, strips or the like.

Also, several balls, rings, rollers or the like may be arranged in a superimposed relation.

The rollers may be both cylindrical, as well as drum-shaped rollers (barrel shaped) which likewise are again arranged in series on a rod or strip. They may, however, as well as the rings, be held by means of a cage, in which the rollers are again freely movable perpendicularly to the web and accordingly in the direction of the exertion of pressure. Upon utilization of balls, the latter may either rotate freely in a cage, or, however, be arranged in series according to the type of a string of pearls or, however, may be held in other suitable manners, as for example by means of the magnetic field itself, in their position movable freely against the web.

The basic idea of the present invention—in complete contrast to previous utilizations, is to utilize individual pressure members extending over the width of the web, which individual members extend in their entirety over the width of the web and permit of being drawn or pressed independently of one another in the direction normal to the web through the application of magnetic forces. If, in the case of apparatus of the present invention, balls, rollers arcuate at their ends, pins or the like are utilized, then by means of the lateral disposition of the pressure bodies lying consecutively in the direction of travel of the web, uniform pressure may be exerted on the web.

A further development of the invention provides an axial and/or tangential guidance of the pressure bodies without mutual contact and with the elimination of a cage or other guide means. For this purpose, the counter-roller or the planar support which is disposed on the side of the web remote from the pressure body field, consist of magnetizable material and is surrounded by a pole shoe of a magnet concentrically, or such a pole shoe lies opposite to the counter-roller or the support made of magnetizable material. In this connection, the pole shoe is provided on its side adjacent the counter-roller or the support with radial projections and reversals determining the axial and/or tangential spacing of the pressure bodies. The length of the projections or the reversals may, in this connection, correspond or approximately correspond to the length or the diameter, respectively, of the pressure bodies.

The projections are preferably formed of pin-like sections, formed by means of longitudinal and transverse grooves, between which sections the front side is held adjacent to the roller or support and the roller or support of the pressure bodies. In another embodiment, the projections of the pole shoe may be constructed as short ribs which project into the axial and/or tangential intermediary spaces between the pressure bodies. A further advantageous embodiment provides that the pole shoe is adjustable movable and/or movable to and fro in radial and/or axial tangential direction to the roller or in corresponding direction to the support, respectively.

In order to be able to alter the size of the tangential magnetic force acting on the pressure bodies, that is, in the direction of travel of the web, in order, for example, to take into account the friction and the fulling or milling work upon the treatment of different materials, and in order to attain a reduction of the resistance of the magnetic circuit, whereby the pressure exerted by the pressure bodies on the web to be treated is attainable with lower construction expense, for example with a lower number of ampere turnes of the electromagnets, the rotating pressure bodies are held in tangential and/or axial recesses limited by sections of the pole shoe by means of magnetic forces, whereby the air gap between the tangential and/or axial recess walls and the pressure bodies is smaller than the air gap between the radial recess wall and the pressure body.

The recess walls enclose or surround more than half of the circumference of the pressure bodies. In this connection, the recesses widen above the tangential metal plane of the pressure body, that is, in the area of the recesses in the pole shoe facing away from the roller.

The walls of the tangential and/or axial pole shoe sections limiting the recesses surround the pressure bodies at least partially concentrically. For the equalization of the tangentially operating friction and fulling or milling forces, the pole shoe sections limiting the recesses are constructed asymmetrically in the tangential direction, as well as also the two walls of the pole shoe sections tangentially limiting the recesses may be provided with coatings of different strength made of non-magnetizable material.

Furthermore, the pole shoe or parts of the pole shoe may be adjusted on the magnet in the tangential direction, whereby the magnet possesses recesses in tangential adjusting direction of the pole shoe.

In a further embodiment of the invention, the pressure bodies may consist of one or more permanent magnets, which are surrounded or limited by non-magnetizable material parts, whereby magnetizable sections are correlated with the magnets and the nonmagnetizable parts.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 illustrates, in elevational section, an embodiment of the invention in which permanent magnets are employed, which magnets are arranged laterally of and above the roller-shaped support constructed of magnetizable material for guiding the web;

FIG. 2 illustrates, also in a partial sectional view, an embodiment of the invention in which the support consists of a roller jacket of magnetizable or non-magnetizable material and the magnet is arranged within the roller jacket;

FIG. 3 illustrates, in sectional elevation, an apparatus in which the web to be treated is carried on a conveyor belt made of magnetizable or non-magnetizable material, which belt slides on a planar support, and in which the pressure bodies are arranged at the height of the planar support, the planar support being a magnet;

FIGS. 7 and 8 illustrate the utilization or pressure bodies in transverse rows disposed consecutively;

DESCRIPTION OF THE PREFERRED EMBODIMENTS

Figure 4:
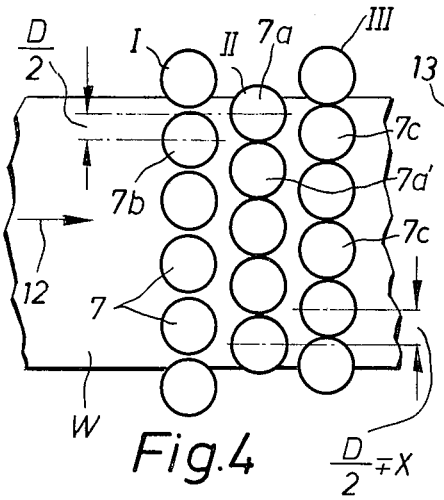
FIGS. 4 and 4*a* illustrate an embodiment of the invention in which the pressure bodies consist of balls which are arranged in rows adjacent one another, the rows disposed consecutively in the direction of travel being offset by half the diameter of the balls and by an amount deviating therefrom from one another.

Referring to FIG. 1, a band W is guided about a roller 1 constructed of magnetizable material. Laterally above the roller 1 is arranged, preferably symmetrically to the vertical center plane, a plurality of electromagnets or permanent magnets 2, having a surface 3 facing the roller which is adapted to the curvature of the roller so that a uniform gap 4 is formed between the roller surface 5 and the magnets 2, whereby also a constant magnetic field is produced between the roller and the magnets, hereinafter simply magnet, 2. The magnet 2 may be adjusted radially of the roller 1, for example, by means of set screws 2*a* which engage on the four corners of the magnet.

Arranged in the gap 4 transversely to the direction of travel of the web (arrow 6) and lying on the web is a plurality of balls 7 disposed adjacent one another and offset in the direction of travel of the web, consecutively, as pressure bodies in transverse rows, whereby the pressure bodies consist of suitable magnetizable material and are drawn under the effect of the magnetic field between the roller 1 and the magnet 2 against the web W perpendicularly to the same independently of one another. As in the discussion below in connection with FIGS. 4–8, the transverse rows of balls 7 following one another in the direction of travel of the web W, are offset to one another, thus for example, the transverse row of balls II of the balls 7 is offset in the transverse direction of the web W by a determined amount. The same holds true for the rows III–IV and V of the balls 7, so that the last end of the intermediary space between the contact point of the balls 7 of the row I is completely covered by the contact point of the rows of balls II–V, and hereby the web W is subjected to pressure over its entire width by means of the balls 7 of the rows I–V.

In the foregoing, only five rows are illustrated for each side of the roller 1, but naturally a greater number of transverse rows of balls may be used, so that finally, for example, approximately 10 to 20 transverse rows of balls are provided, which balls are offset with respect to the balls of a preceding row, in such a manner that, as described above, the entire web is loaded with pressure over its width.

The balls 7 are held in their respective positions by means of a cage 8 in such a manner that the balls remain freely movable with respect to one another perpendicularly to the web W, that is radially of the roller 1. The cage 8 is held and disposed so that it holds the balls in their respective positions in the transverse longitudinal direction of the web; however, also the cage is constructed to be able to raise the balls 7 in their entirety from the web W, if necessary, to draw in a new web. To this end, the magnetic force of the magnet 2 may be removed and the cage 8 with the balls 7 may be moved in the direction of the magnet 2. The cage itself may be held in position on a mounting of the apparatus (not illustrated).

The strength or magnitude of the magnetic field may, for example, through alteration of the coil current of the electromagnet, or through alteration of the air gap 4, be arranged as desired, so that also the pressure of the balls against the web W may be varied.

The surface of the balls may be formed smooth, grooved, rough or in any other desired manner, depending upon the treatment to be performed on the web.

In the embodiment of the invention illustrated in FIG. 2, the balls 7 are again held in a cage 8. Within the roller jacket 9 is arranged an electromagnet or a permanent magnet 2, through which the balls 7 are drawn against the web W. Also, the transverse row of balls of the embodiment of FIG. 2 are offset to one another in the transverse direction of the web W in such a manner that the balls 7 act over the entire surface of the web. The shifting in the transverse direction of the web may also, in this connection, be different or equally great from one transverse row of balls to the next.

In the embodiment illustrated in FIG. 3, a planar support 10 is provided over which a conveyor belt 11 is cause to travel, which belt is disposed on guide rollers and/or on the support 10. The support 10 is constructed as a magnet, and the pressure bodies are also, in this case independently of one another, freely movable perpendicularly to the web W, as also the rows discussed above, i.e. the transverse rows of balls I, II, III, IV, V and VI are transversely offset with respect to one another, so that the entire web is pressure loaded. The above discussion in connection with FIGS. 1 and 2 is also applicable to the apparatus illustrated in FIG. 3, the only differences being between arcuate and planar orientation.

FIG. 4 specifically illustrates an arrangement of rows of balls I, II, III as an example of the shifting transversely of the web W. The balls 7*a* of the transverse row of balls II are offset with respect to one another compared with the balls 7*b* of the transverse row I by half the ball diameter D/2, while the balls 7*c* of the row III are transversely offset in respect of the balls 7*a* of the row II by a slightly less or greater amount than half the diameter, that is $D/2 \pm X$. To a similar degree, the further transverse rows of balls imagined in the direction of travel (arrow 12) of the web W, are offset so that in the last analysis the entire surface of the web is pressure-loaded by means of the balls 7 of the transverse rows I, II, III . . . .

In FIG. 4 it is apparent that the balls 7 are freely movable with respect to each other in the direction of travel of the web W. If, for example, at the level of the balls 7a' in FIG. 4, an unevenness is present in a web of textile, then only the balls 7a' is raised, while the neighboring balls 7a of the same transverse row II exert their pressing function, as well as the others of the balls on the web. This is in clear contrast to a roller or longer roller, in which the adjacent area of a section encountering an unevenness can no longer take effect on the web.

Figure 5:
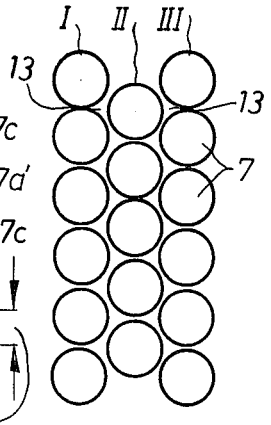
FIGS. 5 and 5*a* illustrate an embodiment of the invention in which the spacing of the rows of balls following one another in the direction of travel of the web is less than the case illustrated in the embodiment of FIG. 4, and the balls of a subsequent row project into the ball gap or space of a previous row.

In the embodiment illustrated in FIG. 5, for spacesaving purpose, the balls of the transverse rows I and II project into the intermediary space 13 between two adjacent balls 7 of the preceding transverse row of balls. In this connection, the balls 7 of the row III are transversely offset by a small degree more or less than D/2 compared with the balls of the row II.

Figure 6:
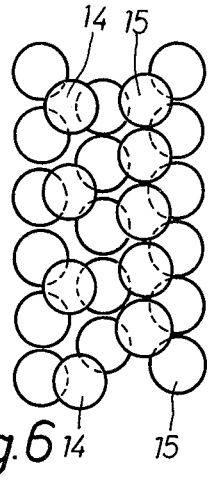
FIGS. 6 and 6*a* illustrate an arrangement of balls in which some balls are superimposed on other balls, it being understood that suitable support means are provided in a working embodiment.
Figure 4A:
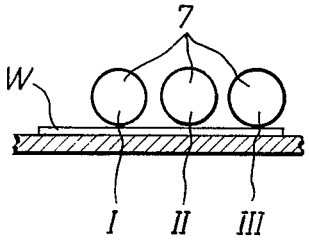
Figure 5A:
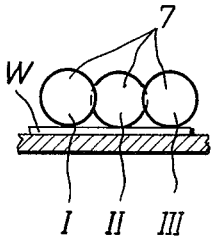

The embodiment according to FIG. 6, is to illustrate that it is also possible to utilize piles of balls, through which, if desired, a still higher pressure may be produced on the web W. The additional balls 14, 15 of the transverse rows VII and VIII are particularly utilizable with apparatus in which a magnet, as illustrated in FIG. 2 is present within the roller jacket. The same holds true, if according to FIG. 3, a planar magnet support is selected.

Figure 6A:
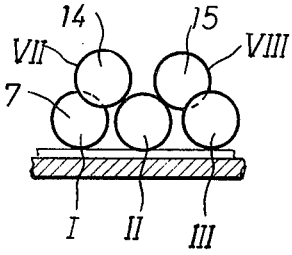

FIG. 6a further illustrates that the balls of the additional transverse rows of balls VII, VIII may lie at a greater lateral spacing (Row VII) or with less spacing (Row VIII) on the balls of the transverse rows of balls I, II, III lying thereunder.

The balls of the transverse rows I–III and VII–VIII, according to FIGS. 4 to 6a, may be held in their position by corresponding holding means, as for example by means of the cages illustrated in FIGS. 1 and 2.

Each possibility of arrangement of balls transversely to the longitudinal direction of travel of the web (looking upstream of the web) is illustrated in FIG. 7, whereby the balls of a first transverse row of balls I (center point M) are indicated at 50, while the balls 51 (center point N) form the second transverse row II, the balls 52 (center point O) are of the third transverse row III, the balls 53 (center point P) are of the fourth transverse row IV, etc. This arrangement corresponds to that illustrated in FIG. 4.

A modification is illustrated in FIG. 8, where the balls 60 (center point M) form the first row I, the balls 61 (center point N) the second row II, the balls 62 (center point O) belong to the third row III, and the balls 63 (center point P) are of the fourth row IV, etc. Here the balls of a row, in each case, are transversely offset by a constant amount with respect to the preceding transverse row.

In the foregoing, transverse rows of balls, barrels and needles are discussed; however, these rows may also extend at an angle to the transverse direction of the web, that is inclined to the longitudinal and transverse direction of the web.

Figure 9:
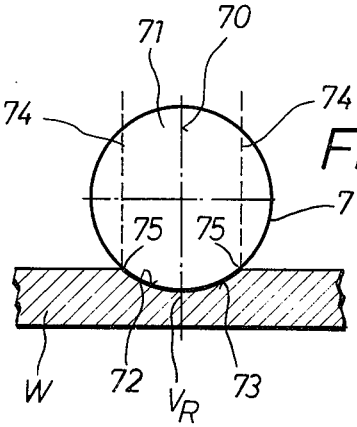
FIG. 9 illustrates, on an enlarged scale, the effect of a ball on a web.
Figure 10:
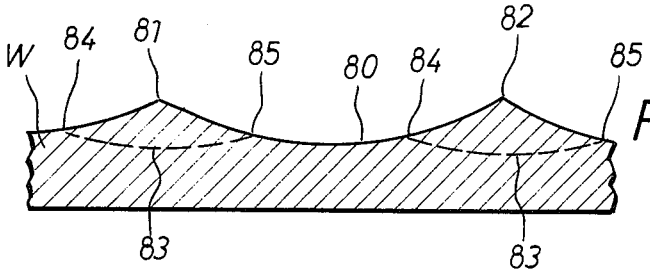
FIG. 10 illustrates, in a cross sectional view, a portion of a treated web.

FIGS. 9 and 10 illustrate the effect of a ball and two adjacent balls arranged offset in the transverse row of balls. The lateral shifting of the two adjacent balls corresponds in this connection to that in FIGS. 4 and 7. In the illustration of FIG. 9, the web W travels out of the sheet; the plane of rotation 70 of the ball 7 lies in the direction of travel of the web W. The drawing notes circumferential or effective surfaces 71 disposed arcuately perpendicularly to this plane 70, the parts 72 of these surfaces producing the cup-shaped or cap-shaped indentation 73 in the web W, which because of the movement of the web introduces a groove of the width of the effective surface 71.

While the section of the ball 7 disposed at the level of the plane of rotation 70 rotates with the circumferential speed $V_R$ corresponding to the speed of the web, the sections 75 adjacent to the side limits 74 of the effective surface 71 have a lower circumferential speed, so that from the plane of rotation 70 of the ball 7 to both sides up to the limits 74 of the effective surface 71, an increasing, slight luster effect of the indentation 73 or the longitudinal groove, respectively, results.

FIG. 10 illustrates, in partial cross-section of the web W in the direction of travel, two transverse rows of balls, whereby, as set forth above, the lateral shifting of the second transverse row of balls is as great as half the ball diameter. Through the ball of the first transverse row of balls, the longitudinal groove 80 is plotted which is limited by the longitudinal ribs 84, 85, which again are compressed during formation of further, always smaller grooves and lower ribs. Finally, the remaining ribs have, according to the last transverse row of balls, a height of the order of size of a material particle, or less.

As is to be inferred from the foregoing, the apparatus requires no expensive calender stand or support having expensive roller bearings and means for applying pressure to the necks of the rollers. These structures require no non-sensitive roller coatings or coverings, no adjustment and grinding or polishing of the rollers. The pressure bodies may be balls, barrels, rings or rollers made of steel, as widely available in the market, with a diameter of preferably 5 to 50 mm.

Cages between the pressure bodies may be eliminated if the magnetic field, with corresponding construction, holds the pressure bodies in their respective positions. If need be, only lateral limits of the pressure body field need be utilized, while the maintenance of the spacing of the pressure bodies with respect to one another is ensured by means of the mutual repulsion of the magnetized pressure bodies.

Figure 11:
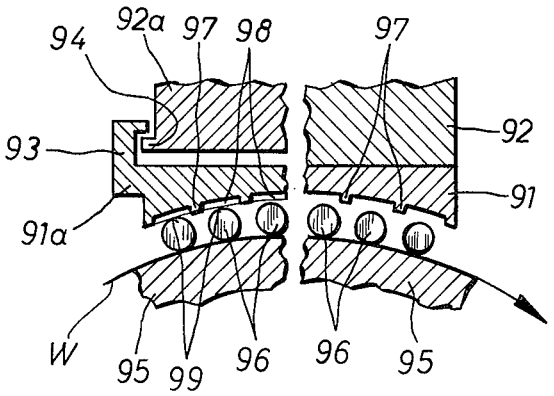

In the embodiment illustrated in FIG. 11, right hand portion, a pole shoe 91 is connected with the magnet 92, while in the left hand portion of FIG. 11, the pole shoe 91a is arranged radially adjustably on the magnet 92a, for which purpose the pole shoe 91a overlaps with symmetrically arranged parts 93 (on the left and right sides of the pole shoe) a projecting attachment 94 of the magnet 92a. The radial adjustability of the pole shoe with respect to the roller 95 has the advantage of being able to widen the permissible finishing tolerances of the apparatus, and to prevent that the web clamps tight upon tearing off between the pressure bodies 96 and the roller 95. Rib-like axially disposed projections 97 may be connected with one another at spacings which correspond approximately to the length or diameter, respectively, of the pressure bodies 96, by means of tangential ribs 98. Viewed against the under side of the pole shoe, there results with the embodiment according to the left-hand portion of FIG. 11, a field of depressions 99 which have rectangular or approximately rectangular shape, and which are limited by the axial projections 97 and the tangential ribs 98.

Figure 12:
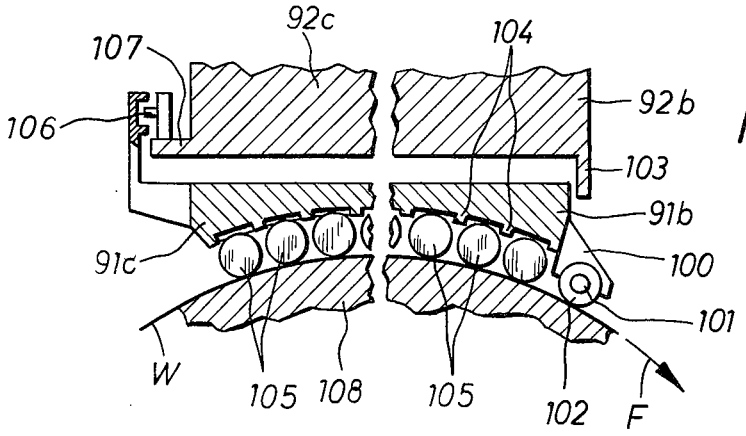
FIGS. 11–22 illustrate various embodiments of pole shoes on a magnet or their construction on the side thereof facing away from the counter support such as a roller.

In the right-hand portion of FIG. 12, the pole shoe 91b is provided with an axial bearing 100, having an axis 101 which is provided with wheels 102 for traveling on the web W. The pole shoe 91b is hereby adjustable in the direction of travel (arrow F) of the web W, that is tangentially. A projection 103 of the magnet 92b may serve as an attachment. Also here, the pole shoe 91b carries axial rib-like projections 104 for the pressure bodies 105.

In the embodiment according to FIG. 12, left-hand portion, the pole shoe 91*c* is provided with guide rollers 106 which are carried and guided on a strip 107 of the magnet 92*c* in the axial direction, that is transversely of the direction of travel of the web W. As the pole shoe 91*c* is guided on both sides of the magnet, it may experience an oscillating movement transversely to the movement of the web W, that is in the axial direction of the roller 108, whereby a changing effect may easily be exerted on the web.

As to the radial and axial movement, there may additionally take place a radial adjustment of the pole shoe, as in the embodiment illustrated in FIG. 11 (left hand portion).

Figure 13:
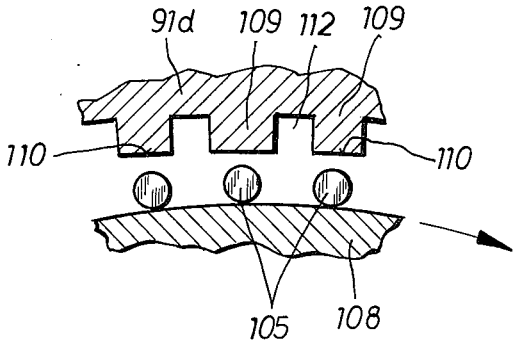
Figure 14:
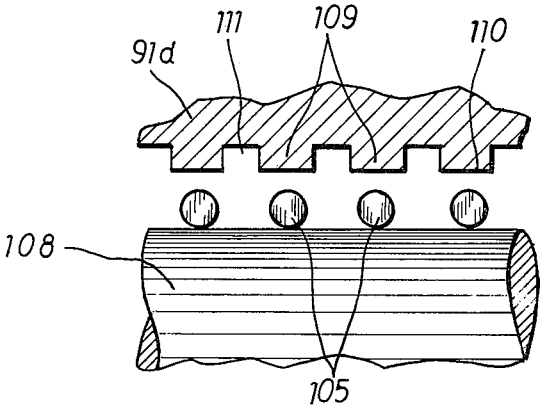

In the embodiment illustrated in FIGS. 13 and 14, the pole shoe 91*d* has pin-like projections 109, between whose round, rectangular or quadratic front sides 110 and the magnetizable roller 108, the pressure bodies 105 are arranged. The pins are preferably limited by tangential grooves 111 (FIG. 14) as well as by axial grooves 112. In the embodiment of FIGS. 13 and 14, the magnetic induction is decreased in the axial and tangential fields limiting the pressure bodies 105, whereby a guidance of the pressure bodies in a low friction manner is attainable. The grooves diminish, in appreciable measure, the stray flux, that is the portion of the magnetic flux which without penetrating the pressure bodies 105 reaches directly from the pole shoe 91*d* to the roller 108. The pressure bodies 105 are held in place in both the direction of travel of the web W and transversely of the web (in the axial direction) without a requirement of additional means for holding the bodies, for example, by means of cages or the like.

In FIGS. 15–20, for the sake of simplicity, instead of a roller of magnetizable material, there is selected as a counter-bearing structure, a planar support made of the same material as would be used as a roller.

Figure 15:
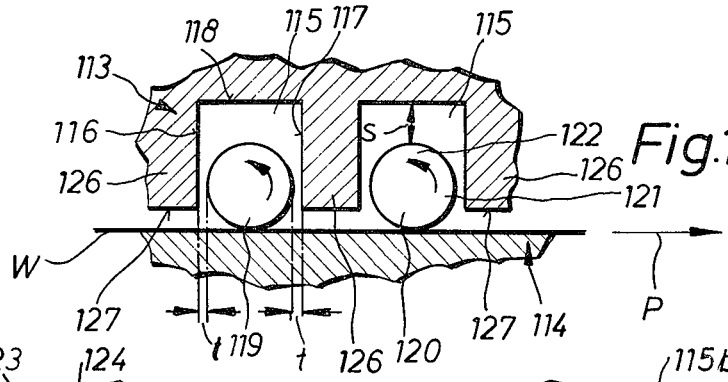

In the embodiment illustrated in FIG. 15, the pole shoe 113 held on a magnet over the support 114 is provided with recesses 115 in the axial direction (transverse to the web W) which recesses are limited in the direction of web travel (arrow P), that is in the tangential direction, and oppositely thereto, by the walls 116, 117. In the radial direction, the recesses 115 are limited by the walls 118. The spacing of the walls 116, 117 of a recess 115 from one another, that is the interior tangential width of the recess is slightly greater than the diameter of the pressure bodies 119 received by the recesses 115, that is the barrels, balls, rollers or the like, and extend only over a portion of the width of the web and in rows axially offset with respect to one another.

The construction of the recesses 115 in reference to the pressure bodies is selected in such a manner that the spacing *t* between the walls 116 and 117 and the adjacent sections 120, 121 of the pressure body 119, is less than the spacing of the particular section 122 of the pressure body from the upper, that is the limiting wall, wall 118 facing away from the support 114.

Figure 16:
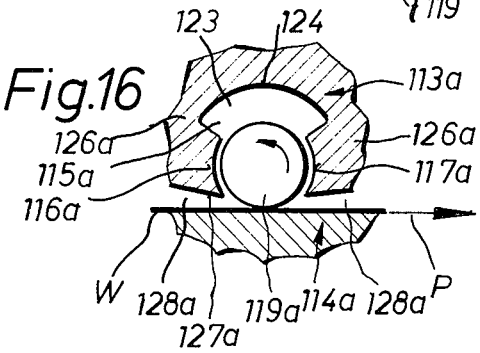

In the embodiment illustrated in FIG. 16, the walls 116*a*, 117*a* of the recess 115*a* of the pole shoe 113*a* concentrically surround the pressure body 119*a*, that is on its section facing away from the support 114*a* into an enlargement 123, whose wall 124 surrounds the pressure body 119*a*, again concentrically.

Figure 17:
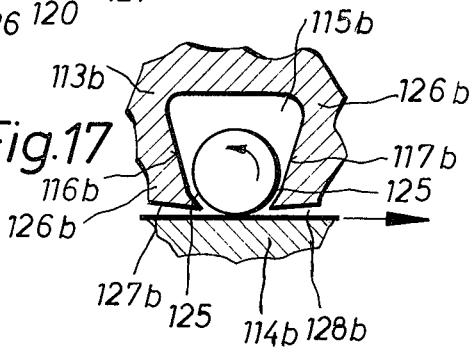

In the embodiment illustrated in FIG. 17, the walls 116*b*, 117*b* of the recess 115*b* of the pole shoe 113*b* extend in a wedge-shaped manner such that a tapering or constriction of the recess 115*b* in the direction toward the web W and the magnetizable support is illustrated. Above the pressure body, that is facing away from the support, the recess 115*b* is likewise widened, while the lower section, that is the section of the recess 115*b* facing the support 114*b* is formed into a uniform intermediary space or chamber 125.

In the embodiment according to FIGS. 15–17, it is apparent that the sections 126 to 126*b* of the pole shoe 113 to 113*b* forming the recesses 115 to 115*b* extend at their front sides 127 to 127*b* close to the web W, whereby the front sides extend either as in FIG. 15 parallel to the support 114, or, however, form a wedge-shaped intermediary space or chamber 128*a*, 128*b*, as in FIGS. 16 and 17.

In order to take into account the friction and fulling force of the web, the recesses or the sections of the pole shoe forming the recesses, respectively, may be constructed differently. Thus, for example, in the embodiment according to FIG. 18, left hand portion, the section 126*c* of the pole shoe 113*c* may be constructed asymmetrically in such a manner that the wall 117*c* extends a greater distance from the web, and therewith from the magnetizable support 114*c*, than the wall 116*c*, when the web is moved in the direction of the arrow P in FIG. 18.

Figure 18:
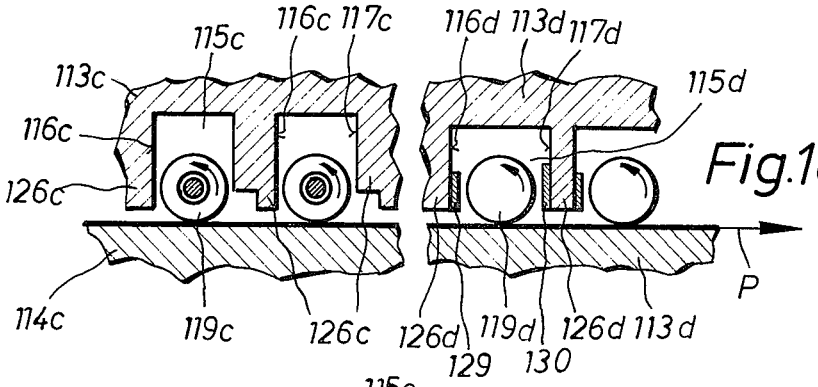

The same object is served by the embodiment of the sections 126*d* of the pole shoe 113*d* illustrated in FIG. 18, right hand portion. Here, the wall 116*d* of the recess 115*d* is provided with a coating 129 of non-magnetizable material, and the wall 117*d* carries, with respect to the same, a greater or larger and thicker coating 130 than the coating 129. As is to be seen, the larger or stronger coating 130 is applied to the wall 117*d* of the recess 115*d*, which viewed in the direction of travel of the web W (arrow P), is laid in front of the pressure body 119*d*.

Figure 19:
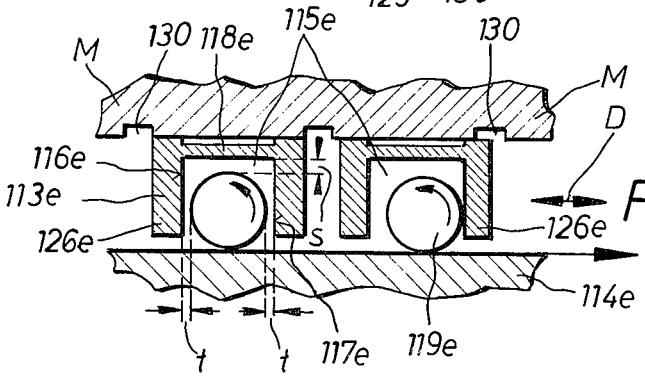

In the embodiment of the invention illustrated in FIG. 19, the pole shoe 113*e* is constructed as an H-shaped member, and is slidable on the magnet M in the direction of the double headed arrow D. Also here, the spacing *t* are less than the spacing *s* between the pressure body 119*e* and the upper wall 118*e* of the pole shoe. In this embodiment, the magnet may be provided with axial grooves 130 on the side of the magnet M on which the pole shoes 113*e* are slidable, and which are adjacent to the support 114*e*. The pressure bodies 119*e* are in the position to move the slidable pole shoes 113*e* into a position on the magnet M, in which the pole shoes, under the influence of the field lines issuing from the sections 126*e*, as well as the friction and the fulling work, assume the central position illustrated in the left-hand pressure body in FIG. 19.

Figure 20:
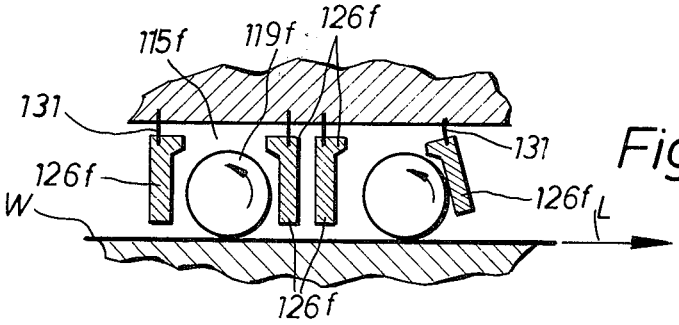

The embodiment illustrated in FIG. 20 is particularly suitable where different speeds of the webs as well as conditions in qualities of webs occur. For this purpose, the sections 126*f* which limit the recesses 115*f* tangentially are pivotal in that they are pivotally mounted by suitable springs 131 in the direction of movement of the web (arrow L) or opposite thereto, respectively. If a pressure body, as shown in FIG. 20 at the right hand pressure body, encounters the corresponding section 126*f*, the latter may swing out and through the magnetic field alteration, as well as through the preferably resilient arrangement, the section 126*f* may exert a return force on the pressure body in such a manner that the pressure body again reaches its central position, or approximately its central position, between the two sections 126*f*, as illustrated in the left hand portion of FIG. 20.

Figure 21:
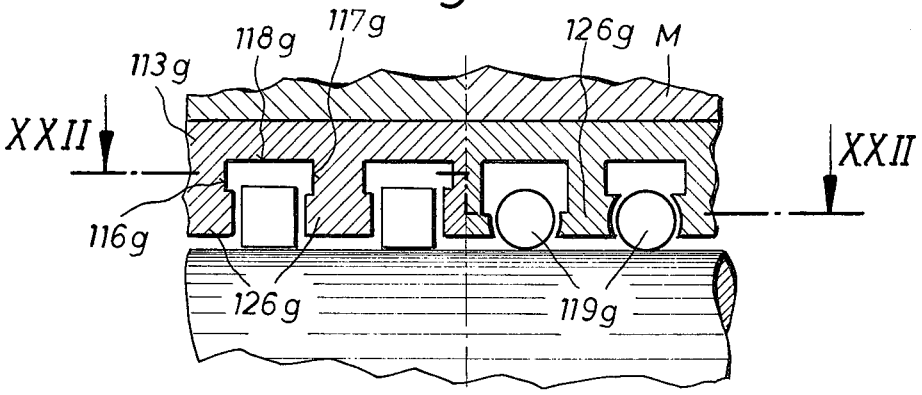
Figure 22:
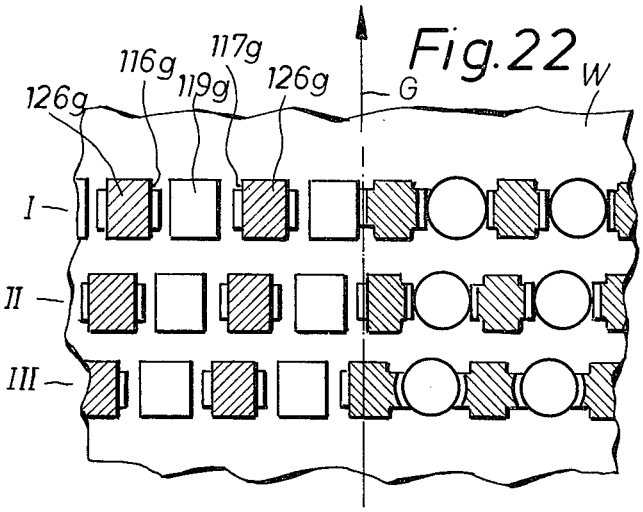

In the embodiment of the invention illustrated in FIG. 21, the pole shoe 113*g* has sections 126*g* which carry walls 116*g*, 117*g* and 118*g*. Further, the construction as illustrated in FIGS. 15 to 20 may be selected. FIG. 22 permits noting that the pole shoes are offset with respect to one another with their sections 126*g* transversely to the direction of travel of the web (arrow G), that a strip like treatment of the web takes place and upon utilization of a pressure body field, the web W is treated over its entire width by means of the pressure bodies.

Figure 23:
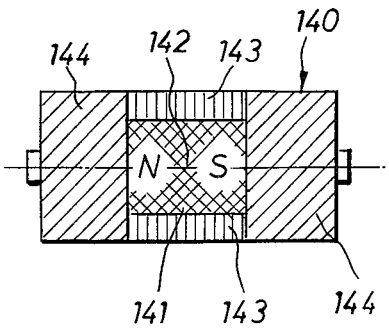
FIGS. 23–25 illustrate the constructional detail of rollers which may be employed in practicing the present invention.

The cylindrical pressure bodies 140 according to FIG. 23 may consist of a permanent magnet 141, whose North-South pole axis 142 coincides with the longitudinal axis of the pressure body, of a bushing 143 made of non-magnetizable material, and end pieces 144 constructed of magnetizable material.

Figure 24:
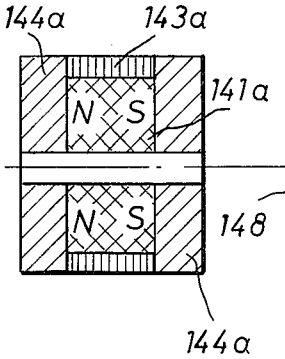

The pressure body illustrated in FIG. 24 has an annularly-shaped permanent magnet 141*a*, which again is closed by a bushing 143*a* made of non-magnetizable material and is limited by end pieces 144*a* made of magnetizable material.

Figure 25:
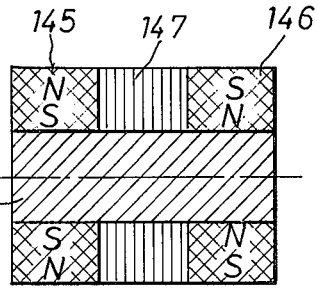

FIG. 25 illustrates a pressure body constructed of two end-sided ring magnets 145, 146, a non-magnetizable center portion 147, and an axial portion 148 constructed of magnetizable material.

Figure 26:
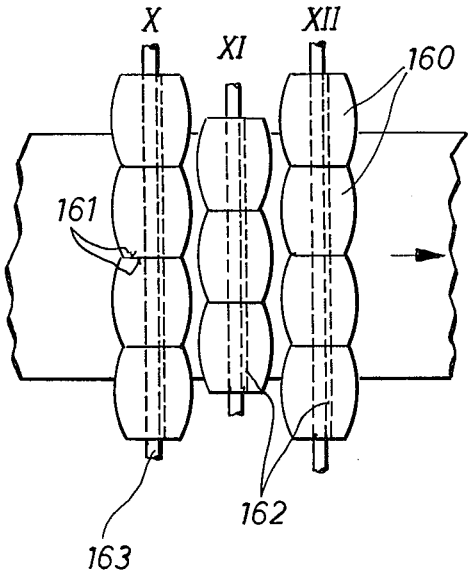
FIGS. 26–28*a* illustrate the utilization of barrels, needles and pins in the structure of pressure bodies constructed in accordance with the present invention.
Figure 26A:
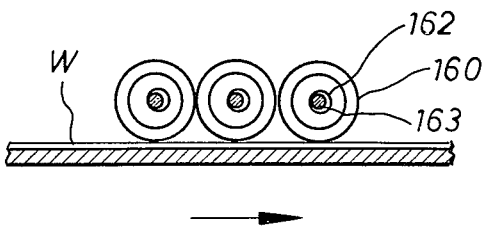

In FIGS. 26 and 26*a*, the pressure bodies 160 are developed as barrels whose front sides 161 contact slightly or not at all. Through the center longitudinal bores 162, for each row of barrels X, XI, XII a rod 163 is guided transversely to the web, the rod having a smaller diameter than the bore 162 of the barrels, so that the barrels may move freely perpendicularly to the web; however, the rod 163 holds the barrels in position. In a narrower construction of the barrels 160, the latter form rings having a similar constructional arrangement.

Figure 27:
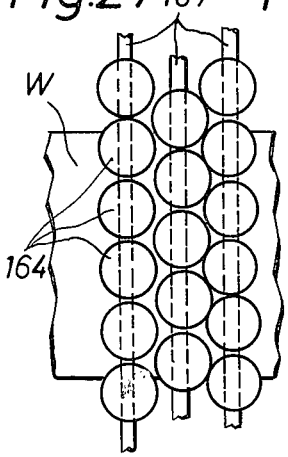
Figure 27A:
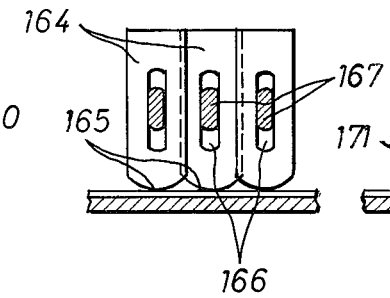

In FIGS. 27 and 27*a*, standing needles 164 having round cross sections are provided. The needles 164 have lower ends 165 which are arcuate and which carry a longitudinal slot 166 through which one of the rods 167, corresponding to the rods 163 of the embodiment of FIGS. 26 and 26*a*, is guided. The rods 167 hold the needles in position; the rods, together with the slots 166 make possible a free movement toward and away from the web W.

Figure 28:
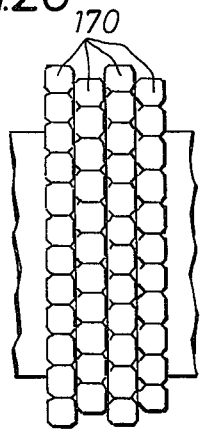
Figure 28A:
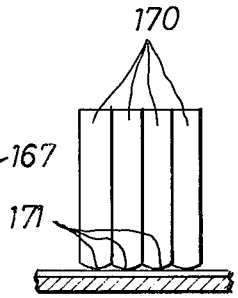

In FIGS. 28 and 28*a* pins 170, of polygonal cross section, have feet 171 and are held mutually in position to engage the upper surface of the web W.

Although I have described my invention by reference to particular illustrative embodiments thereof, many changes and modifications thereof may become apparent to those skilled in the art without departing from the spirit and scope of the invention. I therefore intend to include within the patent warranted hereon all such changes and modifications as may reasonably and properly be included within the scope of my contribution to the art.

What is claimed is:

1. Apparatus for the continuous treatment of a web of material which is traveling along a predetermined path, comprising: a support for supporting the traveling web;

magnetic means adjacent said support for providing a magnetic field directed perpendicular to said support;

a plurality of pressure bodies for pressing against the web under the influence of said magnetic field; and mounting means mounting said pressure bodies in a predetermined pattern extending transversely of the web, said mounting means mounting said pressure bodies for independent movement perpendicular to the web so that deflection of a pressure body by an uneveness of the web is local and ineffective at other pressure bodies.

2. The apparatus of claim 1, wherein each pressure body is a ball.

3. The apparatus of claim 1, wherein each pressure body is a ring.

4. The apparatus of claim 1, wherein each pressure body is a roller.

5. The apparatus of claim 1, wherein each pressure body is a barrel-shaped roller.

6. The apparatus of claim 1, wherein each pressure body is a member having having an arcuate web-engaging end.

7. The apparatus of claim 1, wherein said mounting means comprises transversely extending strips.

8. The apparatus of claim 7, wherein said strips form a cage for rollingly supporting saidd pressure bodies.

9. The apparatus of claim 7, wherein said strips form axles rollingly supporting said pressure bodies.

10. The apparatus of claim 1, wherein said mounting means mounts said pressure bodies offset from one another in the direction of the path of travel of the web.

11. The apparatus of claim 1, wherein said mounting means mounts some of said pressure bodies in superposed relation at a plurality of positions.

12. The apparatus of claim 1, wherein said support includes a first support surface and said magnetic means includes a second planar surface facing said first surface.

13. The apparatus of claim 1, wherein said support and said magnetic means each include an arcuate surface defining a gap therebetween through which the magnetic field is directed.

14. The apparatus of claim 13, wherein said support includes a roller carrying said arcuate surface of said support.

15. The apparatus of claim 14, wherein said magnetic means is mounted outside of said roller.

16. The apparatus of claim 14, wherein said magnetic means is mounted inside of said roller.

17. The apparatus of claim 1, wherein said magnetic means comprises means for varying the magnetic field in the direction of web travel.

18. The apparatus of claim 1, wherein said magnetic means comprises means for varying the magnetic field transversely across the web.

19. The apparatus of claim 1, wherein said mounting means includes a movably mounted frame carrying said pressure bodies.

20. The apparatus of claim 1, wherein said magnetic means comprises a pole shoe adjacent said support and carrying projections which determine the spacing of said pressure bodies.

21. The apparatus of claim 20, wherein said projections extend a distance corresponding to the similar dimension of said pressure bodies.

22. The apparatus of claim 21, wherein said projections are pin-like sections formed by longitudinal and transverse grooves.

23. The apparatus of claim 1, wherein said mounting means comprises a pole shoe magnetically coupled to said magnetic means and having grooves therein forming projections which define the locations of said pressure bodies.

24. The apparatus of claim 1, wherein said magnetic means comprises:

a pole shoe magnetically coupled to said magnetic means and projections extending from said pole shoe to define recesses receiving said pressure bodies, said recesses each having side walls and an end wall with the air gap between a pressure body and a side wall being less than the air gap between the pressure body and the end wall.

25. The apparatus of claim 24, wherein said side walls include arcuate portions partially surrounding the respective pressure body.

26. The apparatus of claim 24, wherein said pole shoe has a leading edge and a trailing edge with respect to web travel, and wherein each recess includes a leading side wall and a trailing side wall the leading side wall extending toward the web a greater distance than the trailing side wall.

27. The apparatus of claim 24, wherein said pole shoe has a leading edge and a trailing edge with respect to web travel, and wherein each recess includes a leading side wall and a trailing side wall, and a non-magnetic layer on said leading and trailing side walls, the layer on said trailing side wall covering a greater area than the layer on said leading side wall.

28. The apparatus of claim 1, wherein said mounting means comprises a pole shoe member magnetically coupled to an slidable on said magnetic means and said magnetic means includes transverse grooves, said pole shoe members centered between adjacent grooves in response to the combined effects of the magnetic field, the running friction and pulling of the web on said pressure members.

29. The apparatus of claim 28, wherein each of said pole members has a generally H-shaped cross section.

30. The apparatus of claim 1, wherein said mounting means comprises a pole shoe magnetically coupled to said magnetic means, and a plurality of projections extending from said pole shoe for receiving said pressure bodies therebetween, said projections spring mounted to said pole shoe for deflection by and return centering of said pressure bodies.

31. The apparatus of claim 1, wherein said mounting means comprises a carriage including wheel means for rollingly supporting said carriage on the traveling web.

32. The apparatus of claim 31, comprising first coupling means on said magnetic means; and second coupling means on said carriage engageable with said first means to limit movement of said carriage.

33. The apparatus of claim 1, wherein each of said pressure bodies comprises at least one permanent magnet and sections of magnetizable and non-magnetizable material.

34. A method of continuously treating a web of material comprising the steps of:

moving the web along a predetermined path past a work station; supporting the moving web at the work station; and applying a magnetic field to a plurality of individual freely movable pressure members at the work station to locally press the web while permitting local deflections of the individual pressure members by uneven portions of the web.

35. The method of claim 34, wherein the step of moving and supporting the web are further defined as supporting the web with a roller to define a curved path of web travel.

36. The method of claim 35, wherein the step of applying a magnetic field is further defined by the steps of providing and directing a magnetic field radially of the roller.

37. The method of claim 36, wherein the step of directing the magnetic field is further defined as directing the magnetic field radially inwardly from outside of the roller.

38. The method of claim 36, wherein the step of directing the magnetic field is further defined as directing the magnetic field radially outwardly from inside of the roller.

* * * * *